US008973206B1

(12) United States Patent
Vivonetto

(10) Patent No.: US 8,973,206 B1
(45) Date of Patent: Mar. 10, 2015

(54) TROWEL WITH DEPTH ADJUSTMENT

(71) Applicant: Jack Vivonetto, Naples, FL (US)

(72) Inventor: Jack Vivonetto, Naples, FL (US)

( * ) Notice: Subject to any disclaimer, the term of this patent is extended or adjusted under 35 U.S.C. 154(b) by 0 days.

(21) Appl. No.: 14/097,411

(22) Filed: Dec. 5, 2013

(51) Int. Cl.
*B05C 17/10* (2006.01)
*E04F 21/00* (2006.01)
*E04F 21/16* (2006.01)

(52) U.S. Cl.
CPC ..... *E04F 21/161* (2013.01)
USPC ..... 15/235.8; 15/235.4; 425/458

(58) Field of Classification Search
USPC ..... 15/235.3, 235.4, 235.8; D8/45; 425/458
See application file for complete search history.

(56) References Cited

U.S. PATENT DOCUMENTS 1,008,382 A * 11/1911 Sourek ..... 15/197
1,193,478 A * 8/1916 Downs ..... 15/235.3
1,354,443 A * 9/1920 Wright ..... 15/235.3
2,910,861 A * 11/1959 Thornhill ..... 15/235.3
3,758,945 A 9/1973 Finnegan, Jr.
4,901,801 A 2/1990 Popivalo
5,231,729 A 8/1993 Rose
7,028,366 B2 4/2006 Brozoska
7,757,335 B1 7/2010 Servidio
8,256,809 B2 9/2012 Coutu
2009/0217476 A1 9/2009 Hurley et al.

FOREIGN PATENT DOCUMENTS

GB 2259938 3/1993

* cited by examiner

*Primary Examiner* — Randall Chin
(74) *Attorney, Agent, or Firm* — Livingston Loeffler, P.A.; Edward M. Livingston, Esq.; Bryan L. Loeffler, Esq.

(57) ABSTRACT

A trowel (1) having a rounded plate (6) slidably attached to a flat plate (5). The flat plate is preferably attached to an angled handle (10). Curved prongs (2) extend from the flat plate through apertures (7) located within the rounded plate. The prongs are used to obtain a desired depth of a bed of mortar (9) as the rounded plate is used to smooth out the mortar bed. An upper surface (11) of the rounded plate may be used as a scraper or scoop when the trowel is turned over.

11 Claims, 2 Drawing Sheets

TROWEL WITH DEPTH ADJUSTMENT

FIELD OF THE INVENTION

This invention relates to the installation of tile on mortar beds and a device for laying a bed of mortar evenly at a desired height to ensure that each tile laid on the mortar bed is the exact same height, thereby creating a level field of tiles.

BACKGROUND OF THE INVENTION

Thick set mortar beds used for installing tile, also referred to as thick-bed installations, are based on the traditional method of packing a mortar bed over a surface or substrate before installing tile. The tile is adhered to the mortar bed either while the mortar bed is still wet or after the mortar bed has cured using a mastic. The terms thick-bed installation, mortar bed installation, and thick-set installation are synonymous.

Mortar beds allow an installer of tile to level out unevenness in the substrate, thereby creating an ideal surface to which the tile can be bonded.

This is especially important when laying uneven tiles. Natural stone tiles, such as slate, marble, travetrertine, limestone and so forth, often have unfinished or unpolished lower surfaces that when placed on a thin set of mastic have a tendency of coming into contact with the uneven areas of substrate and not laying level. This causes an uneven unprofessional installation job. In addition, this can cause the tiles to have raised edges that are tripping hazards. Thus, thick-bed installation is ideal for natural stone tiles.

However, a common problem with the installation of mortar beds is the time and work involved with laying and troweling the mortar. The skill required to lay an even bed of mortar using a conventional trowel is a major factor in the cost and time required to ensure the mortar bed is perfectly level and thus the tiles are laid evenly.

Therefore, a need exists for a trowel having depth adjustment guides that level a mortar bed to an even desired height over an uneven substrate.

The relevant prior art includes the following references:

| Pat. No. | Inventor | Issue/Publication Date |
|---|---|---|
| (U.S. Patent References) | | |
| 3,758,945 | Finnegan, Jr. | Sep. 18, 1973 |
| 4,901,801 | Popivalo | Feb. 20, 1990 |
| 5,231,729 | Rose | Aug. 3, 1993 |
| 7,028,366 | Brozoska | Apr. 18, 2006 |
| 2009/0217476 | Hurley et al. | Sep. 3, 2009 |
| 7,757,335 | Servidio | Jul. 20, 2010 |
| 8,256,809 | Coutu | Sep. 4, 2012 |
| (Foreign Patent References) | | |
| GB2,259,938 | Phillips | Mar. 31, 1993 |

SUMMARY OF THE INVENTION

The primary object of the present invention is to provide a trowel having depth adjustment guides that level a mortar bed to an even desired height over an uneven substrate.

The present invention fulfills the above and other objects by providing a trowel having a rounded plate slidably attached to a flat plate. The flat plate is preferably attached to an angled handle. Curved prongs extend from the flat plate through apertures located on the rounded plate. The prongs are used to obtain a desired depth of a mortar bed as the rounded plate is used to smooth out the mortar bed. An upper surface of the rounded plate may be used as a flat trowel or scoop when the trowel is turned over.

An added feature of the trowel is that the handle of the device may be extendable and/or interchangeable.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
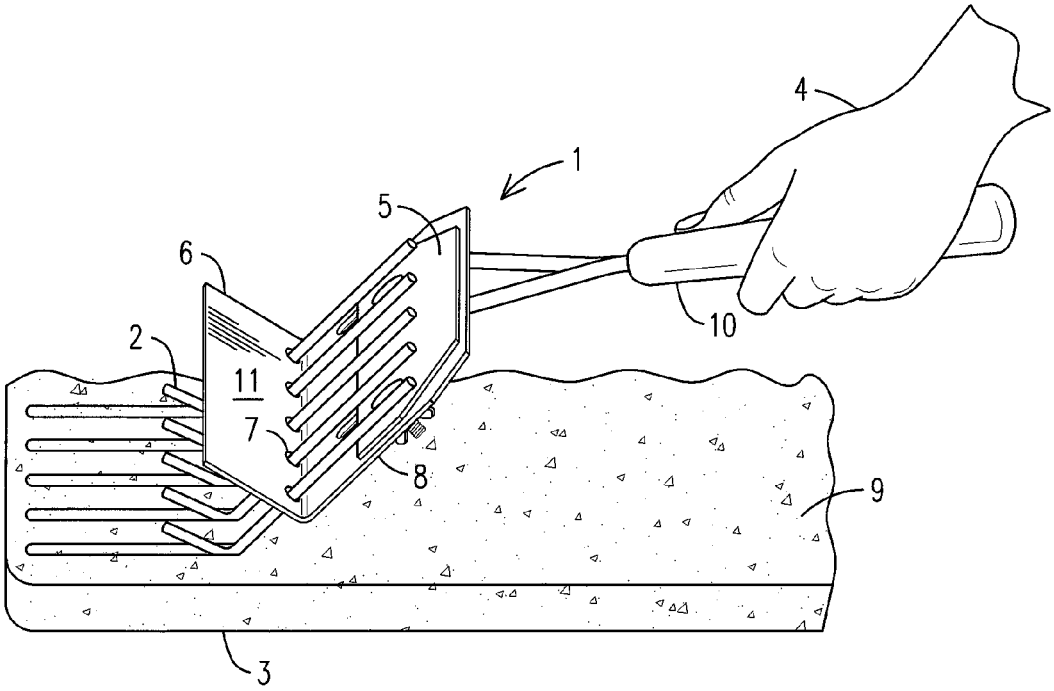
FIG. 1 is a side view of a trowel of the present invention in use with a plurality of prongs pressed against a substrate to obtain a desired depth as the trowel is being pulled toward a user.
Figure 3:
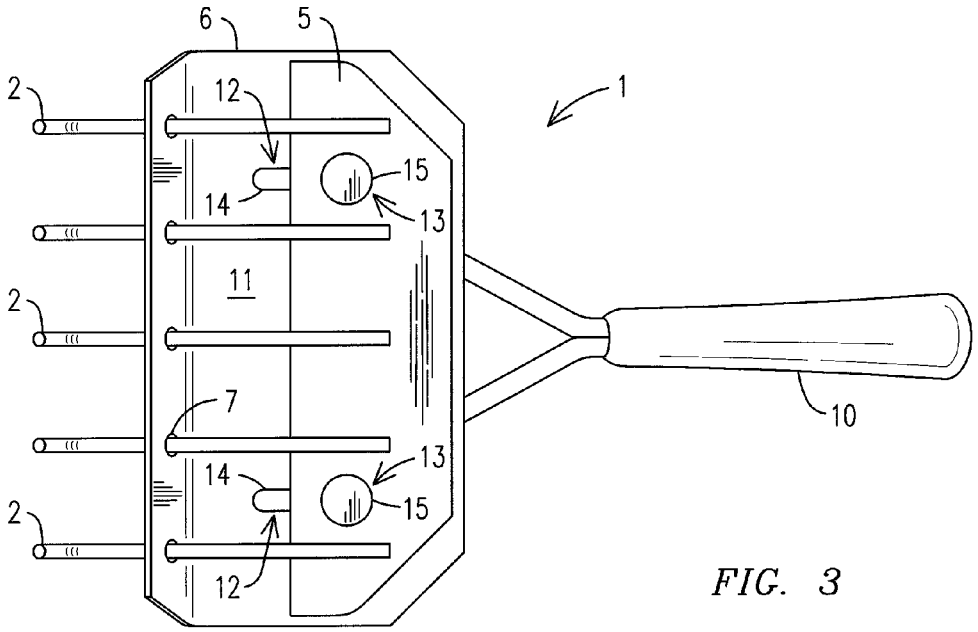
FIG. 3 is a top view of a trowel of the present invention.
Figure 4:
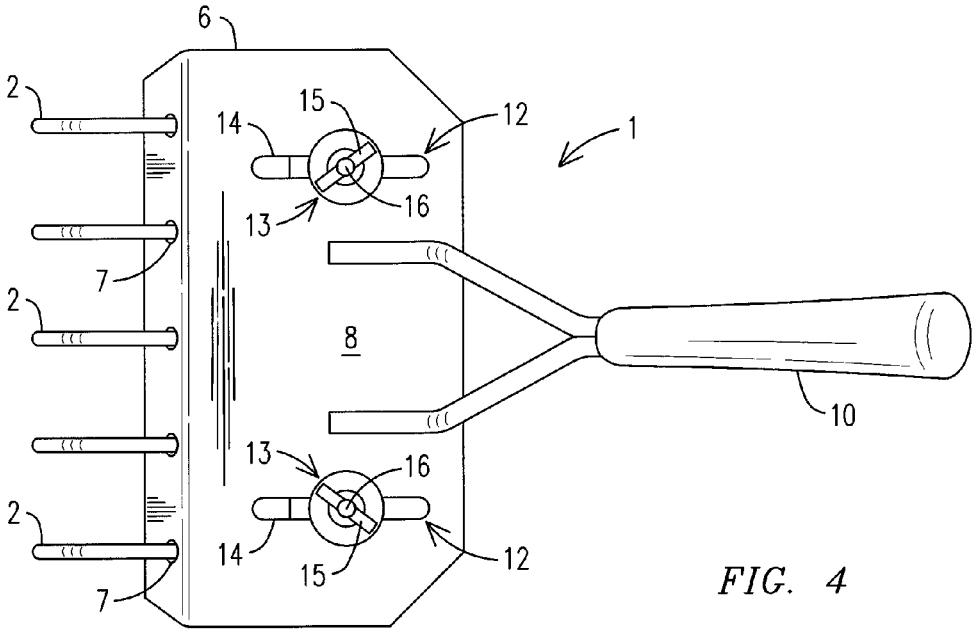
FIG. 4 is a bottom view of a trowel of the present invention.

For purposes of describing the preferred embodiment, the terminology used in reference to the numbered components in the drawings is as follows:

1. trowel, generally
2. prong
3. substrate
4. user
5. flat plate
6. rounded plate
7. aperture
8. lower surface of rounded plate
9. mortar bed
10. handle
11. upper surface of rounded plate
12. sliding means
13. locking means
14. slot
15. nut
16. bolt With reference to FIG. 1, a side view of a trowel 1 of the present invention in use with a plurality of prongs 2 pressed against a substrate 3 as the trowel 1 is being pulled toward a user 4 is illustrated. The trowel 1 comprises a plurality of prongs 2 extending from a flat plate 5 slideably attached to a rounded plate. The plurality of prongs 2 extend through corresponding apertures 7 located in the rounded plate 6 (as illustrated in FIGS. 3 and 4). The plurality of prongs 2 are preferably curved so that they are substantially parallel to the rounded plate 6. This allows the plurality of prongs 2 to maintain a proper depth as a lower surface 8 of the rounded plate 6 smoothes the surface of the mortar bed 9 as the trowel 1 is pulled through the mortar bed 9 using a handle 10 located on the trowel 1.

Figure 2:
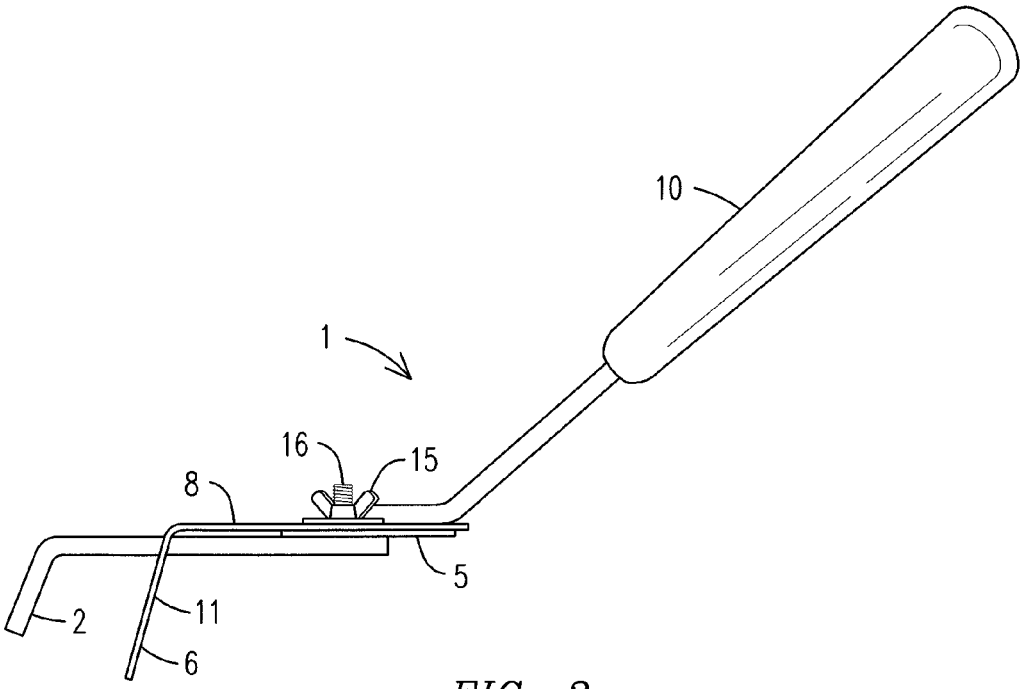
FIG. 2 is a side view of a trowel of the present invention flipped upside down.

With reference to FIG. 2, a side view of a trowel 1 of the present invention flipped upside down is illustrated. By turning the trowel 1 over an upper surface 11 of the rounded plate 6 may be used as a scraper or scoop.

With reference to FIGS. 3 and 4, a top view and a bottom view, respectively, of a trowel 1 of the present invention are illustrated. The flat plate 5 is slideably attached to the rounded plate 6 by a sliding means 12 and a locking means 13. As illustrated here, the sliding means 12 is at least two slots 14 located on the rounded plate 6 and/or the flat plate 5 and at least one locking means 13, such as nuts 15 and bolts 16 that fit though the slots 14. Other sliding means 12 and locking means 13 may include combinations of guides, clamps and so forth. The slideability of the flat plate 5 and rounded plate 6 allow a user to extend the prongs 2 through the apertures 7 in the rounded plate 6 depending on the desired height of the bed of mortar 9 being placed over the substrate 3, as illustrated in FIG. 1.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

I claim:

1. A trowel that levels a mortar bed to an even desired height over a substrate comprising:

a plurality of prongs extending from a rounded plate;

said plurality of prongs being curved;

a handle located on the trowel; and a plurality of apertures located on the rounded plate through which the plurality of prongs extend through.

2. The trowel of claim 1 further comprising:

a flat plate attached to the rounded plate on which the plurality of prongs is attached.

3. The trowel of claim 2 wherein:

the rounded plate and the flat plate are slideably attached together.

4. The trowel of claim 3 further comprising:

at least one locking means located on the trowel to lock the rounded plate in a desired position in relation to the flat plate.

5. The trowel of claim 4 wherein:

the locking means is at least one nut and at least one bolt.

6. The trowel of claim 3 wherein:

the rounded plate and the flat plate are slideably attached together by at least two slots having bolts placed through the slots and nuts for locking the rounded plate in a desired position in relation to the flat plate.

7. A trowel that levels a mortar bed to an even desired height over a substrate comprising:

a plurality of prongs extending from a rounded plate;

said plurality of prongs being curved;

a handle located on the trowel;

a flat plate attached to the rounded plate on which the plurality of prongs is attached; and a plurality of apertures located on the rounded plate through which the plurality of prongs extend through.

8. The trowel of claim 7 wherein:

the rounded plate and the flat plate are slideably attached together.

9. The trowel of claim 8 further comprising:

at least one locking means located on the trowel to lock the rounded plate in a desired position in relation to the flat plate.

10. The trowel of claim 9 wherein:

the locking means is at least one nut and at least one bolt.

11. The trowel of claim 8 wherein:

the rounded plate and the flat plate are slideably attached together by at least two slots having bolts placed through the slots and nuts for locking the rounded plate in a desired position in relation to the flat plate.

* * * * *